US006325334B1

(12) United States Patent
Achleitner et al.

(10) Patent No.: US 6,325,334 B1
(45) Date of Patent: Dec. 4, 2001

(54) COUPLING DEVICE FOR A POINT ACTUATOR AND/OR LOCK

(75) Inventors: Herbert Achleitner, Graz; Josef Hörtler, Knittelfeld, both of (AT)

(73) Assignee: Vae Aktiengesellschaft, Vienna (AT)

( * ) Notice: Subject to any disclaimer, the term of this patent is extended or adjusted under 35 U.S.C. 154(b) by 0 days.

(21) Appl. No.: 09/529,877

(22) PCT Filed: Oct. 13, 1998

(86) PCT No.: PCT/AT98/00241

§ 371 Date: Apr. 21, 2000

§ 102(e) Date: Apr. 21, 2000

(87) PCT Pub. No.: WO99/20511

PCT Pub. Date: Apr. 29, 1999

(30) Foreign Application Priority Data

Oct. 22, 1997 (AT) ..... 1785/97

(51) Int. Cl.[7] ..... E01B 7/00
(52) U.S. Cl. ..... 246/452
(58) Field of Search ..... 246/415 R, 430, 246/435 R, 442, 449, 450, 452, 448

(56) References Cited

U.S. PATENT DOCUMENTS

| | | | | |
|---|---|---|---|---|
| 1,960,377 | | 5/1934 | Goodaire et al. . | |
| 2,205,114 | * | 6/1940 | Bone | 246/452 |
| 2,208,449 | * | 7/1940 | Bone | 246/452 |
| 2,687,859 | * | 8/1954 | Arnold et al. | 246/452 |
| 2,712,914 | * | 7/1955 | Lavarack et al. | 246/452 |
| 2,730,319 | * | 1/1956 | Arnold et al. | 246/452 |

FOREIGN PATENT DOCUMENTS

| | | |
|---|---|---|
| 388 198 B | 5/1989 | (AT) . |
| 20 24 121 A | 12/1971 | (DE) . |

OTHER PUBLICATIONS

Patent abstracts of Japan, vol. 095, No. 006, Jul. 31 1995 & JP 07 076275 A ( Kyosan Electric Mfg Co Ltd; Others: 01), Mar. 20, 1995.

* cited by examiner

*Primary Examiner*—Mark T. Le
(74) *Attorney, Agent, or Firm*—Kevin E. Joyce

(57) ABSTRACT

In a connecting device for a switch actuator and/or a lock for movable parts of a railway switch or crossing, including a rod assembly, in particular a sliding rod or a locking rod articulately connected with the movable part, the movable part or the rod assembly, in particular the switch tongue (2), is rigidly connected with a strap (4) engaging from behind a pin (5) connected with the rod assembly or the movable part for transmitting tensile forces. Between the rod assembly and the strap (4) or the movable part is arranged at least one elastic compression element, which is compressible by the rod assembly in the abutment position of the movable part on a rigid rail part, the strap (4) being displaceable out of abutment on the pin (5).

17 Claims, 4 Drawing Sheets

COUPLING DEVICE FOR A POINT ACTUATOR AND/OR LOCK

This application is the national phase of international application PCT/AT98/00241 filed Oct. 13, 1998.

BACKGROUND OF THE INVENTION

1. Field of the Invention

The invention relates to a connecting device for a switch actuator and/or a lock for movable parts of a railway switch or crossing, including a rod assembly, in particular a sliding rod or a locking rod articulately connected with the movable part.

2. Prior Art

Switch actuators of the initially defined kind are described, for instance, in AT-B 388 198 and EP-B1 603 156. In the configuration according to AT-B 388 198 a long-hole connection is provided, via which a locking clamp that is displaceable by means of a sliding rod is articulately connected with the switch tongue. In EP-B1 603 156, which introduced a switch actuator with an integrated lock or a locking device, respectively, the connection with the movable rail tongue is realized via a joint piece which is articulately connected with the lock, or with the foot of the switch tongue, via pins. In those configurations, both tension and pressure are transmitted via the pin connection, wherein an additional connecting rod is required in configurations in which coupling is effected merely by means of a thrust member, said additional connecting rod transmitting the tensile connection during actuation and displacement in the counterdirection. The known couplings or connection devices, as a rule, serve to transmit vibrations from the tongue into the continuing rod assembly or into the locks and actuators. The admissible tongue play under applicable norms is limited to about 3 mm. If, in addition, articulations tolerate an additional play, this may result in the undesired non-release of the switch.

SUMMARY OF THE INVENTION

The invention aims to provide a connecting device by which vibrations of the tongues or the movable parts of switches and crossings can be completely kept off the actuating and locking system and forces can be taken up without play, thereby enhancing the operating safety and service life. To solve this object, the connecting device according to the invention of the initially defined kind essentially consists in that the movable part or the rod assembly, in particular the switch tongue, is rigidly connected with a strap engaging from behind a pin connected with the rod assembly or the movable part for transmitting tensile forces and that at least one elastic compression element is arranged between the rod assembly and the strap or the movable part, which compression element is compressible by the rod assembly in the abutment position of the movable part on a rigid rail part, said strap being displaceable out of abutment on the pin. Due to the fact that a strap rigidly connected with the movable part engages a pin connected with the rod assembly from behind for transmitting tensile forces only, the safe absorption of the tensile forces is ensured, wherein the transmission of pressure forces for pressing on switch tongues or movable parts of a switch or rail crossing is effected via a separate elastic compression element arranged between the rod assembly and the strap or the movable part. Said elastic compression element merely transmits the pressure forces, whereby, in the event of pressing caused in a manner in which the strap engages the pin from behind, not only elastic pressing is allowed, but the strap is displaced out of abutment on the pin, too. In the abutment position a defined play is, thus, present between the strap and the pin such that vibrations exclusively act on the rod assembly with the elastic compression element being interposed, wherein, at the same time, the tongue play is reduced accordingly without joints or parts of the switch actuating means or of the lock being exposed to elevated mechanical stress.

According to a preferred further development of the connecting device according to the invention, the configuration is devised such that the pin is fixed in a fork-like lug laterally encompassing the strap and connected with the rod assembly and is arranged transverse to the direction of displacement of the rod assembly. Such a fork-like lug renders feasible an arrangement in which the pin is located below the rail foot, thus, in the main, allowing for compact dimensions without any impediments caused by the tongue foot. The pin, however, may as well be located approximately in the axis of the sliding rod or locking rod, wherein in that case the elastic compression element advantageously is arranged between the pin and the rail foot and there acts on the strap or on the rail foot itself.

In a particularly simple manner the configuration is devised such that the elastic element is comprised of a compression spring which cooperates with the strap or the movable part via a contact part. Such a compression spring can absorb high forces by a short way so as to ensure the safe decoupling of the rod assembly from vibrations.

In order to further reduce the risk of premature wear, the configuration advantageously is devised such that the contact part has a cambered outer surface, wherein preferably the pin, in addition, has an outer surface that is curved in a barrel-shaped manner. The cambered outer surface of the contact part serves to safely take up eccentric pressure forces, whereas the barrel-shaped outer contour of the pin also allows for the transmission of eccentric tensile forces without mechanically overstressing the strap. The risk of a premature wear may even be further reduced in that the compression spring is arranged in a conically tapering recess of the rod assembly, or a rod assembly head, and is connected with the rod assembly or rod assembly head, respectively, so as to be pivotable out of the axis of the rod assembly, wherein, in that case, the compression spring is pivotable out of the axis within the conical region which is provided with a suitable counterstop for the compression spring. That pivotability, in principle, may be ensured by an elastic core by which the fixation of the compression spring within a recess of the rod assembly or rod assembly head, respectively, is realized, such that simple mounting is feasible. Advantageously, the configuration in that case, however, is devised such that the compression spring, in a positive and force-transmitting as well as frictionally engaged manner, is connected with a tension spring formed by a helical spring, whose inner end facing away from the contact part is fixed with play in an axial bore of the rod assembly or rod assembly head, respectively, and whose outer end, which is encompassed by the compression spring, is connected with the contact part. The compression spring fixed in the axial bore of the rod assembly or rod assembly head, respectively, and formed by a helical spring thereby allows for the pivoting of the compression spring within the conically tapering recess.

BRIEF DESCRIPTION OF THE DRAWINGS

In the following, the invention will be explained in more detail by way of exemplary embodiments schematically illustrated in the drawing. Therein.

DETAILED DESCRIPTION OF PREFERRED EMBODIMENTS OF THE INVENTION

Figure 1:
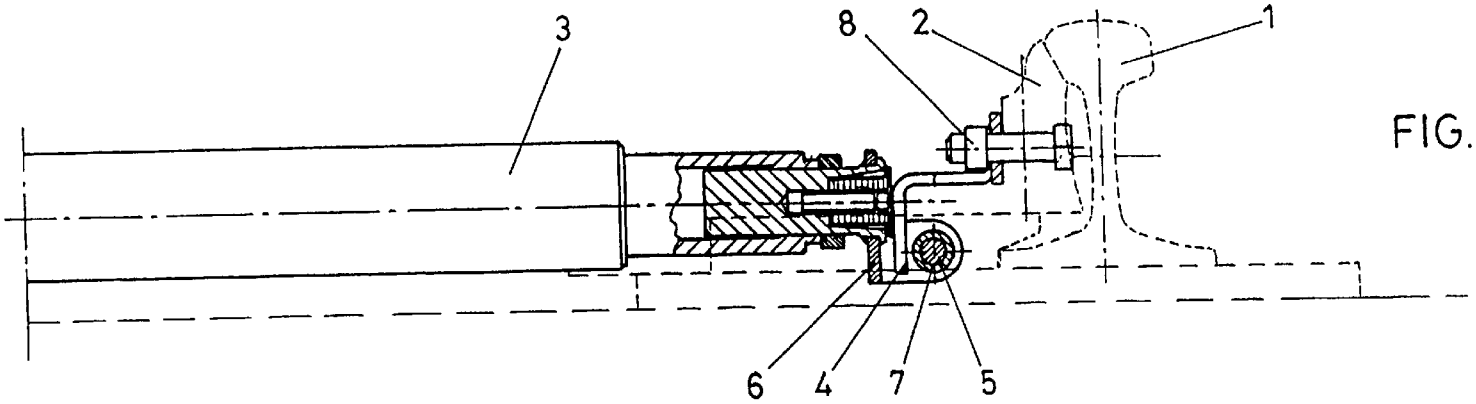
FIG. 1 represents a first embodiment of the connecting device according to the invention for a switch actuator having an integrated lock, and a switch tongue.

In FIG. 1, 1 denotes a standard rail toward which a switch tongue 2 may be pressed. The switch actuator 3 comprises an integrated lock and enables the switch tongue 2 to be pressed towards the standard rail 1 or to be moved away from the standard rail. The transmission of the tensile forces required for moving the switch tongue 2 away from the standard rail 1 is effected via a cranked strap 4 which cooperates with a pin 5. The pin 5 is fixed in a fork-shaped lug 6 and carries a cambered jacket tube 7 such that only a line contact exists between the strap 4 and the jacket tube 7 as tensile forces are being transmitted.

The strap 4 is rigidly connected with the switch tongue 2 via screw bolts 8.

Figure 2:
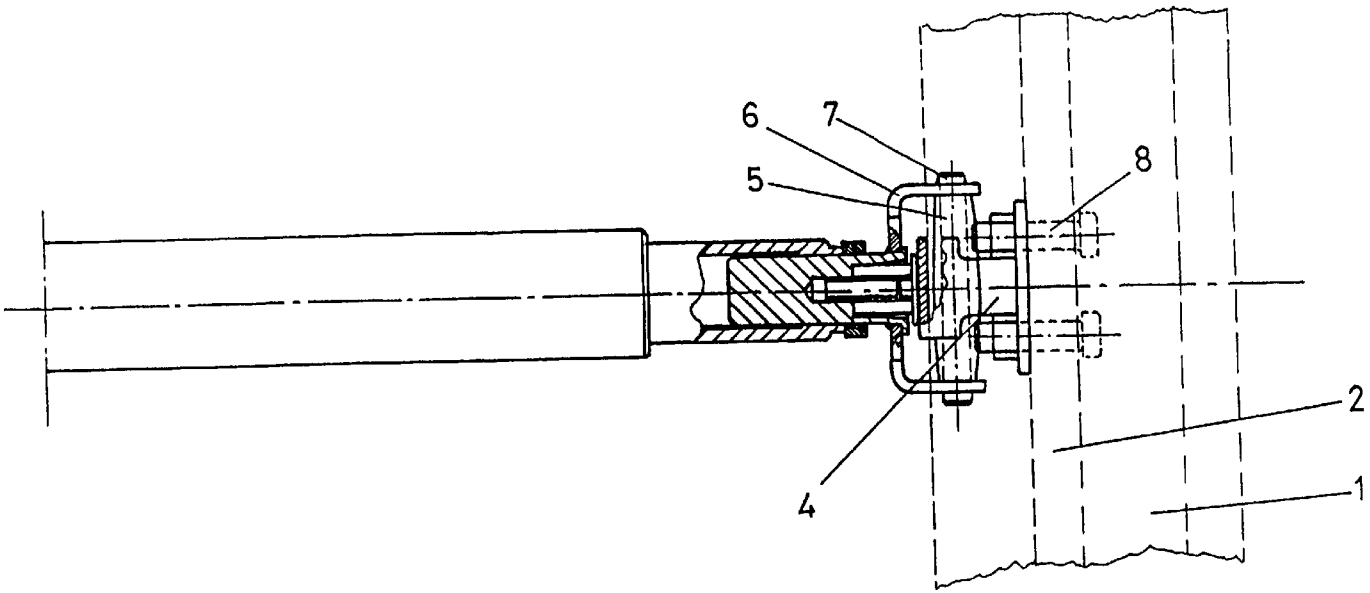
FIG. 2 is a partially sectioned top view on FIG. 1.

In the top view according to FIG. 2, the cambered outer contour of the pin 5 is to be seen and the forked shape of the lug 6 carrying the pin is, furthermore, apparent. The lug 6 encompasses parts of the strap 4 such that a compact mode of construction is rendered feasible.

Figure 3:
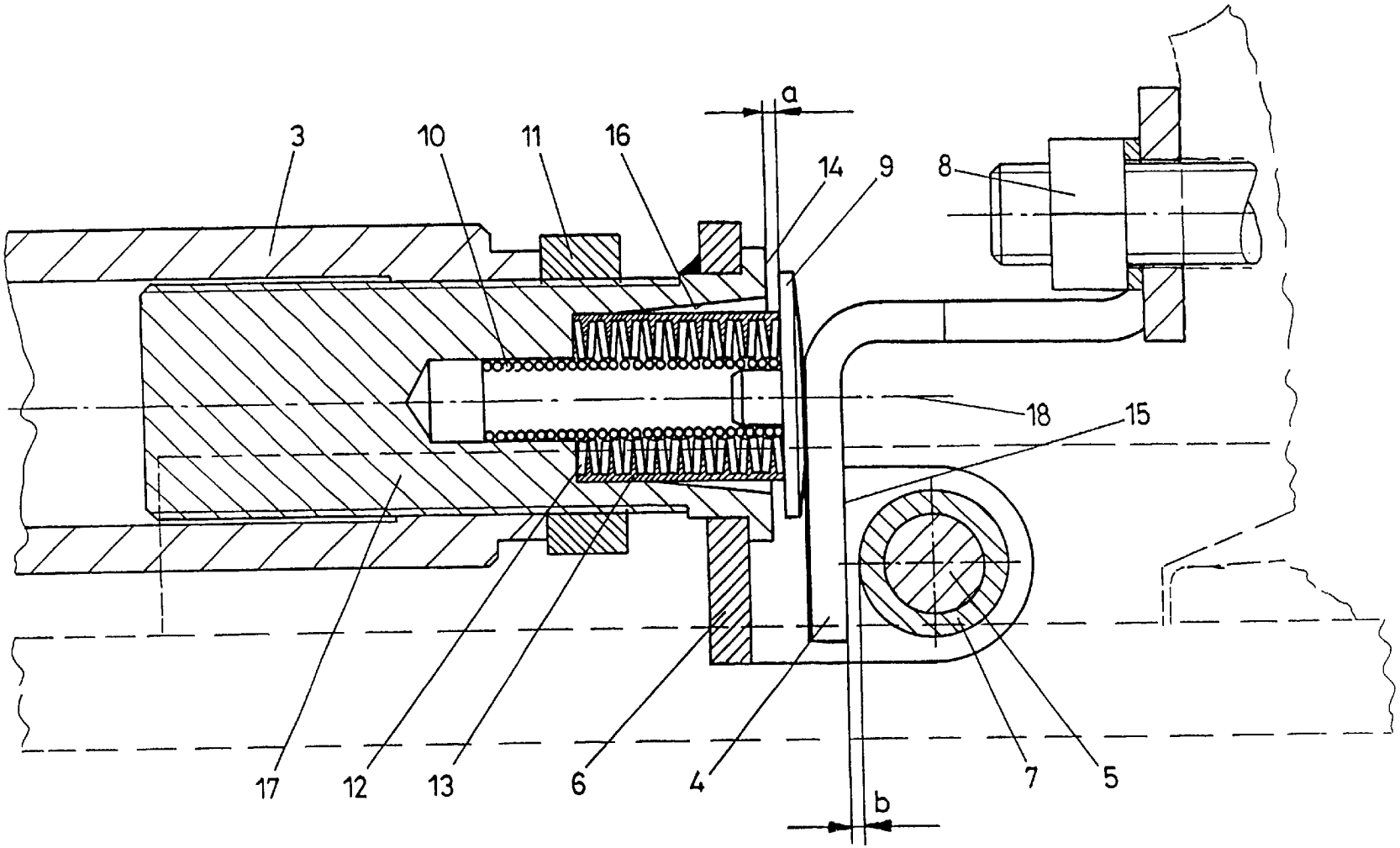
FIG. 3 is an enlarged illustration of the embodiment according to FIG. 1 or 2.
Figure 4:
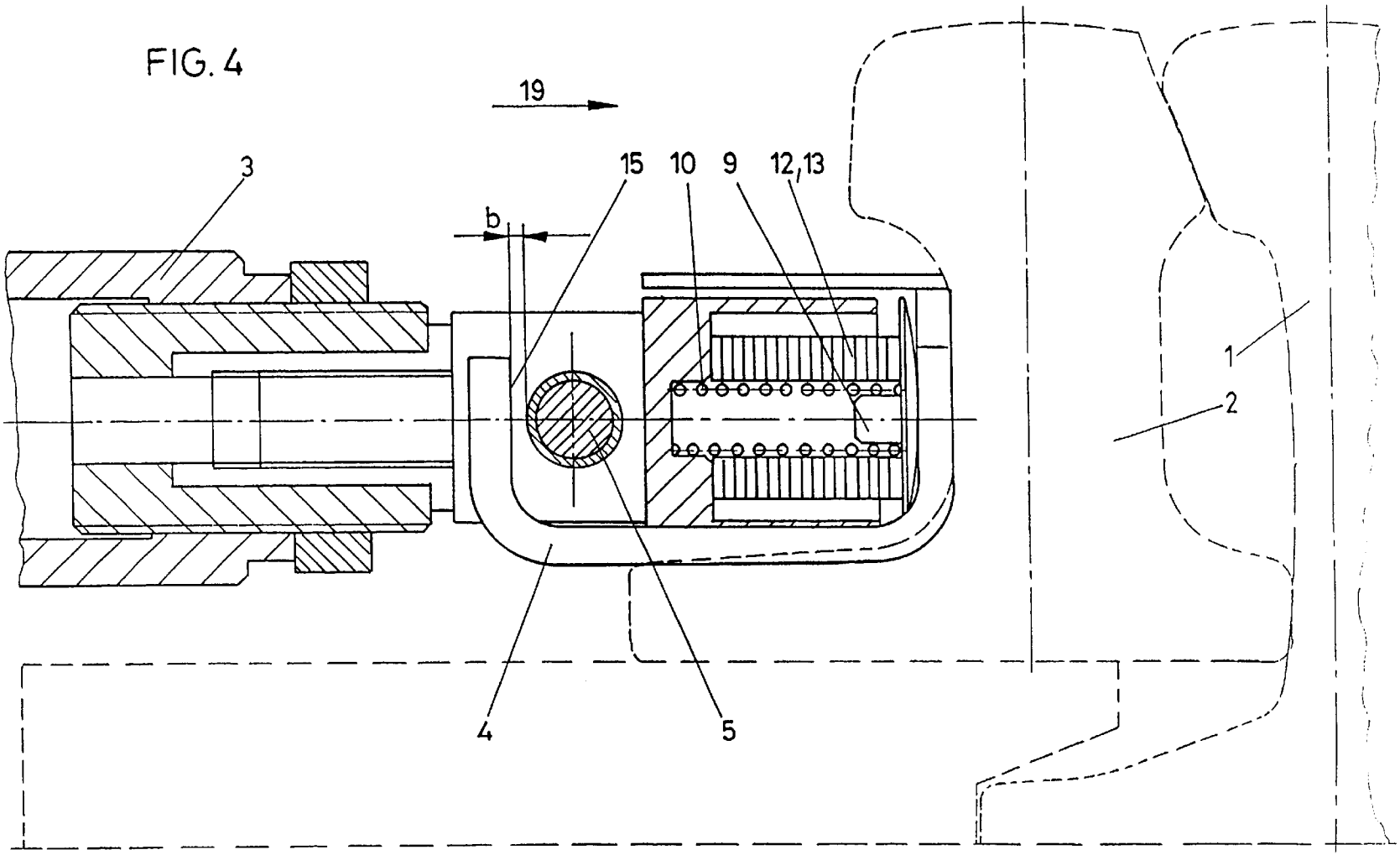
FIG. 4 is a modified embodiment of a connecting piece in an illustration analogous to FIG. 3.

The details of the configuration are elucidated in FIGS. 3 and 4. As is apparent from FIG. 3, a thrust piece 9 having a cambered outer surface is connected with the switching actuator 3, its fixation being effected by means of a flexible tension spring helix 10 inserted in a bore without play. A counternut for fixing the part that carries the bore is denoted by 11. In a conical recess having an accordingly larger internal diameter is inserted a compression spring 12, whose outer shell is formed by a rubber armoring 13 which is pressed in on the inner end of the bore 16 in a positive and force-transmitting as well as frictionally engaged manner. Upon displacement of the switch tongue 2 into the abutting position, the compression spring 12 enters into action on the strap 4 via the contact part 9, thereby causing the tongue 2 to be elastically pressed towards the standard rail 1, while the pin 5 is simultaneously lifted off the strap 4, getting out of its abutting relationship. The maximum displacement under simultaneous prestress of the compression spring 12 will be reached when the contact part 9 directly abuts on the respective end face 14 of the rod assembly, the configuration in that case being devised such that a play a will remain even with the tongue being in a position pressed against the standard rail, in order to safely keep vibrations off the rod assembly and the switch actuator 3. At the same time, the pin 5 is displaced by a distance b and brought out of engagement with the strap 4.

Upon displacement moving the switch tongue out of contact with the associated rail, the inner surface 15 of the strap 4 again gets into an abutting relationship on the cambered or barrel-shaped outer contour of the pin 5 without a pressure connection between the contact part 9 and the strap 4 being required in that position.

The conical recess 16 of the rod assembly head 17 allows for pivoting of the compression spring 12 from the longitudinal axis 18 of the rod assembly, wherein the automatic axial alignment will again be reached in the released condition by means of the tension spring 10.

In the embodiment according to FIG. 4, a modified rod assembly head is provided and strap 4 has been modified. Also in FIG. 4, the abutment position of the tongue rail 2 on the standard rail 1 is again illustrated, wherein, in that position, the compression spring stack 12 together with its rubber armoring 13 is pressed on the tongue foot or the interposed strap. Such pressing on is effected during simultaneous movement of the pin 5 in the direction of the arrow 19, whereby the outer contour of the barrel-shaped jacket of the pin 5 is again lifted off the internally located end face 15 of the strap 4. Vibrations, thus, can be introduced into the switching actuator 3 only upon interposition of the compression spring 12 and the rubber armoring 13. Coupling in the tension direction opposite to the direction of the arrow 19 after abutment of the outer contour of the pin 5 on the associated contact surface 15 may be effected in a manner in which the compression spring 12 is completely relieved and not forced into engagement with the tongue rail foot or the strap 4.

The configuration according to the invention, thus, merely requires the mounting of a holding strap on the tongue, which overlaps the cambered tube in a manner so as to provide for transverse and vertical mobilities of the tongue. With the tongue being in abutting relationship as described above, the contact part 9 abuts the end face of the holding strap and presses the tongue 2 towards the stock rail via the compression spring 12.

The active movement away of the tongue rail is feasible only after having overcome the play provided to that end, wherein transverse movements of the contact part are balanced out in a simple manner on account of the conical opening in which the compression spring is mounted. If the tongue is actuated by the compression spring also in the open position, the tongue is prestressed without play in any position so as to completely avoid an additional tongue play. Vibrations of the tongue are kept away from the actuating and locking system, slanted positions remaining without influence in both adjusting directions and enabling the safe transmission of the desired forces effecting movement.

Figure 5:
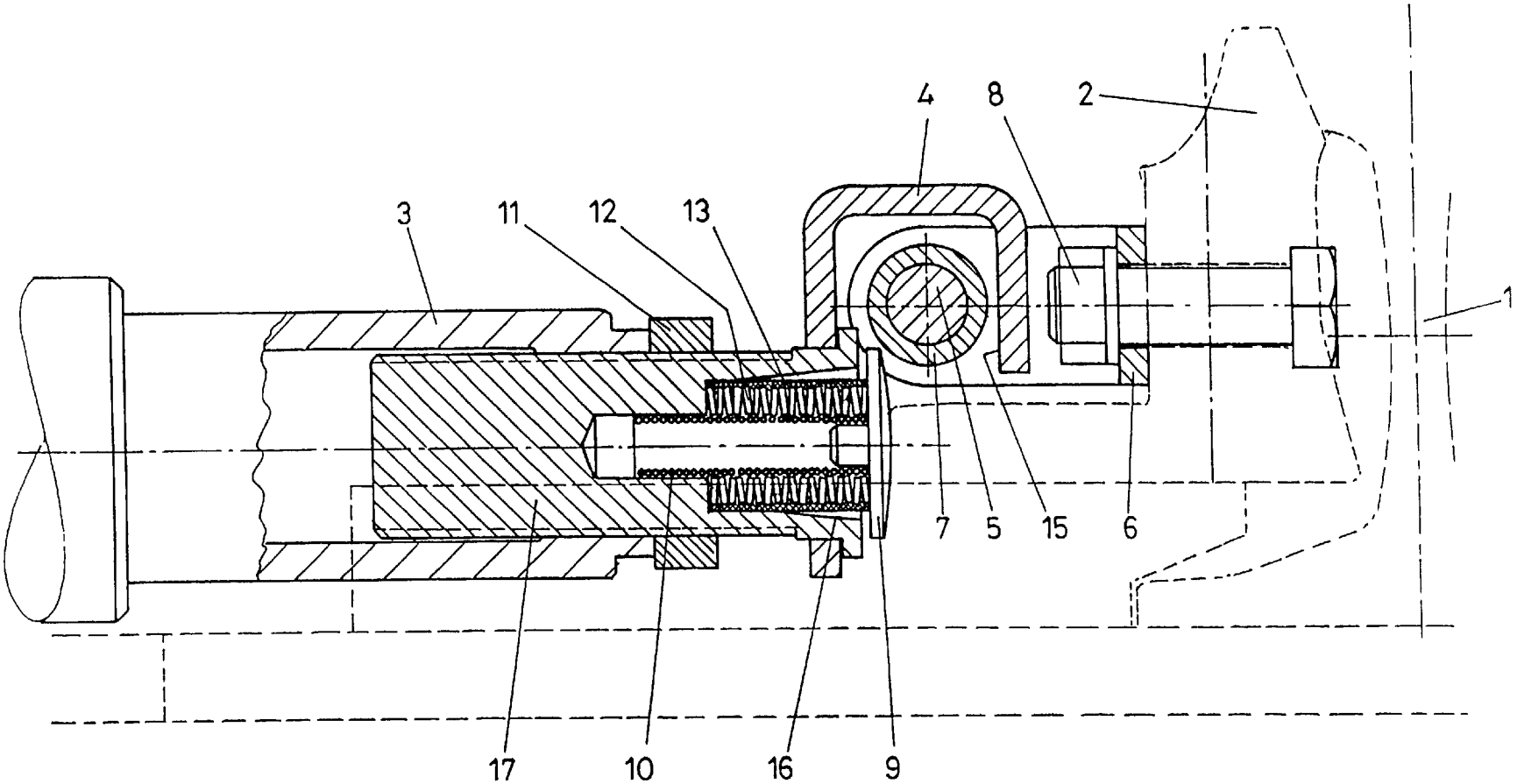
FIG. 5 is yet another embodiment of the connecting piece in an illustration analogous to FIG. 3.

From FIG. 5, a further modified embodiment is apparent, which differs from the configuration illustrated in FIG. 3 merely in that the fixation of the strap 4 is realized not on the switch tongue 2, but on the rod assembly head 17 carrying the bore 16 and connected with the switch actuator 3. On the other hand, the lug 6 carrying the pin 5 in the instant embodiment is rigidly connected with the switch tongue 2 via screw bolts 8. The reference numerals of the preceding Figures have been retained in FIG. 5 for identical structural components, wherein the compression element and thrust piece 9 in this embodiment enter into action directly on the tongue foot of the switch tongue 2 in order to enable appropriate pressing.

What is claimed is:

1. A railway switch/crossing arrangement having a connecting device, a movable rod assembly and switch tongue parts, said arrangement comprising:

a strap rigidly connected to one of said rod assembly and said switch tongue;

a pin connected to the other of said rod assembly and said switch tongue;

at least one elastic compression element arranged between the rod assembly and one of said strap and said switch tongue, the compression element being compressed by the rod assembly, and the strap being displaced from abutment with the pin, when the switch tongue abuts a rigid rail part.

2. An arrangement according to claim 1, wherein the pin is retained by a fork-like lug laterally encompassing the strap, said lug being connected with the rod assembly with the pin being oriented such that the pin's longitudinal axis extends transverse to a direction of displacement of the rod assembly.

3. An arrangement according to claim 1 or 2, wherein the compression element is arranged in a conically tapering recess of the rod assembly, and is connected with the rod assembly so as to be pivotable relative to a longitudinal axis of the rod assembly.

4. An arrangement according to claim 1 or 2, wherein the pin has an outer surface that is curved in a barrel-shaped manner.

5. An arrangement according to claim 4, wherein the compression element is arranged in a conically tapering recess of the rod assembly so as to be pivotable relative to a longitudinal axis of the rod assembly.

6. An arrangement according to claim 1 or 2, wherein the elastic element is a compression spring which cooperates with the strap or the switch tongue part via a contact part.

7. An arrangement according to claim 6, wherein the contact part has a cambered outer surface.

8. An arrangement according to claim 7, wherein the pin has an outer surface that is curved in a barrel-shaped manner.

9. An arrangement according to claim 8, wherein the compression spring is arranged in a conically tapering recess of the rod assembly so as to be pivotable relative to a longitudinal axis of the rod assembly.

10. An arrangement according to claim 9, wherein the compression spring, in a positive and force transmitting as well as frictionally engaging manner, is connected with a helical tension spring having an inner end facing away from the contact part and an outer end which is encompassed by the compression spring and which is connected with the contact part, said tension spring being disposed with play within an axial bore of the rod assembly.

11. An arrangement according to claim 6, wherein the compression spring is arranged in a conically tapering recess of the rod assembly so as to be pivotable relative to a longitudinal axis of the rod assembly.

12. An arrangement according to claim 11, wherein the compression spring, in a positive and force transmitting as well as frictionally engaged manner, is connected with a helical tension spring having an inner end facing away from the contact part and an outer end which is encompassed by the compression spring and which is connected with the contact part, said tension spring being disposed with play within an axial bore of the rod assembly.

13. An arrangement according to claim 6, wherein the pin has an outer surface that is curved in a barrel-shaped manner.

14. An arrangement according to claim 13, wherein the compression spring is arranged in a conically tapering recess of the rod assembly so as to be pivotable relative to a longitudinal axis of the rod assembly.

15. An arrangement according to claim 14, wherein the compression spring, in a positive and force transmitting as well as frictionally engaging manner, is connected with a helical tension spring having an inner end facing away from the contact part and an outer end which is encompassed by the compression spring and which is connected with the contact part, said tension spring being disposed with play within an axial bore of the rod assembly.

16. An arrangement according to claim 9, wherein the compression spring is arranged in a conically tapering recess of the rod assembly so as to be pivotable relative to a longitudinal axis of the rod assembly.

17. An arrangement according to claim 16, wherein the compression spring, in a positive and force transmitting as well as frictionally engaging manner, is connected with a helical tension spring having an inner end facing away from the contact part and an outer end which is encompassed by the compression spring and which is connected with the contact part, said tension spring being disposed with play within an axial bore of the rod assembly.

* * * * *